United States Patent [19]

Goodrich

[11] Patent Number: 4,509,580

[45] Date of Patent: Apr. 9, 1985

[54] BOTTOM BLOCK

[75] Inventor: David G. Goodrich, Danville, Calif.

[73] Assignee: Kaiser Aluminum & Chemical Corporation, Oakland, Calif.

[21] Appl. No.: 448,084

[22] Filed: Dec. 9, 1982

[51] Int. Cl.[3] ..... B22D 11/08

[52] U.S. Cl. ..... 164/445; 164/425

[58] Field of Search ..... 164/425, 426, 445, 446

[56] References Cited

U.S. PATENT DOCUMENTS 3,702,152 11/1972 Bryson ..... 164/425 X

FOREIGN PATENT DOCUMENTS 810062 8/1951 Fed. Rep. of Germany ..... 164/425
427781 4/1975 U.S.S.R. ..... 164/425
900949 1/1982 U.S.S.R. ..... 164/425

*Primary Examiner*—Kuang Y. Lin

*Attorney, Agent, or Firm*—Andrew E. Barlay

[57] ABSTRACT

This invention relates to an improved bottom block for vertical DC and EM casting large ingots and billets, particularly ingots having generally rectangularly shaped cross sections which are rolled into sheet and plate. The improved bottom block stably supports the ingot or billet in its downward descent during casting so that the ingot or billet does not move on the bottom block by leaning off center or rocking back and forth. In accordance with the invention, a plurality of drain holes in the bottom block, which are adapted to remove coolant which collects on the top surface of the bottom block, are provided with fan shaped recesses which form appendages on the butt of the ingot or billet. These ingot or billet appendages ride up the lower inclined surfaces of the recesses when the ingot or billet butt shrinks and curls, thereby stabilizing the ingot or billet.

11 Claims, 9 Drawing Figures

BOTTOM BLOCK

This invention generally relates to the direct chill (DC) casting of large ingots or billets, particularly rectangularly shaped ingots, of light metals, such as aluminum and aluminum alloys. As used herein, the term "aluminum" includes both pure aluminum and aluminum alloys.

In conventional DC casting, molten metal is poured into the feed end of an open-ended tubular mold and solidified or partially solidified metal exits from the discharge end of the mold. The mold itself is cooled by a body of coolant maintained at the backside of the mold by means of water jacket. Coolant, usually water, is applied around the periphery of the ingot as it exits from the mold to effect solidification. In the casting of light metals, such as aluminum, coolant is usually directed by means of one or more baffles from the body of coolant in the water jacket down the backside of the mold and out suitable slots or conduits at the bottom of the mold onto the ingot exiting the discharge end of the mold.

EM casting is similar to the above-described conventional DC casting except that the lateral shape of the molten metal is controlled by electromagnetic pressure generated by the annular inductor surrounding the column of molten metal, rather that the bore of the mold as in conventional DC casting. A more complete discussion of EM casting is found in U.S. Pat. No. 3,985,179 and U.S. Pat. No. 4,004,631 and the references cited and/or discussed therein, all of which are hereby incorporated by reference.

In vertical DC and EM casting, a bottom block is positioned within the discharge end of the mold (for DC casting) or within the discharge end of the electromagnetic inductor (for EM casting) to close off the discharge opening and to hold the molten metal until it has solidified enough to maintain its final desired shape. When the metal has been sufficiently solidified, the bottom block is lowered out of the discharge end of the mold or inductor to allow the solidified ingot to be discharged from the mold or inductor in a continuous or semicontinuous fashion. Once the withdrawal of the bottom block begins, the drop rate thereof is usually maintained at a constant level until the end of the cast, because any sudden change in the drop rate can result in changes in the cross-sectional dimensions of the solidified ingot along the length thereof and can cause serious surface defects on the ingot.

In conventional DC casting, there is very little, and in EM casting, there is essentially no horizontal support of the solidified ingot in its downward descent, so the ingot must be well balanced on the bottom block to avoid rocking or leaning off center. However, as the butt of the ingot solidifies and cools, the ingot shrinks, resulting in the butt of the ingot curling primarily in the widest dimension. The bottom face of the ingot in contact with the bottom block generally forms an arcuate surface so that if the ingot becomes unbalanced or lateral forces are somehow applied to the ingot, the arcuate or curved bottom surface of the ingot will allow the ingot to lean off center or to rock back and forth on the bottom block, both of which produce serious ingot deformation.

When the butt of the ingot curls at the start of the cast, coolant applied to the ingot surface flows into the space between the bottom block and the ingot butt. The heat in the butt end of the ingot causes the water which collects there to vaporize, frequently with such severity that the ingot literally bounces on the bottom block due to the force applied by the vaporizing steam. Such bouncing seriously disrupts the casting process much in the same manner as nonuniform drop rates but with much greater severity, particularly in electromagnetic casting.

To avoid the problems caused by the vaporization of coolant which collects between the ingot butt and the bottom block, the prior art has employed holes or other means in the bottom block to remove the coolant before it explosively vaporizes. Exemplary prior art includes German Pat. No. 893,690, U.S. Pat. No. 3,702,152, and U.S. Pat. No. 3,702,631. However, these references are not directed to the problem of the ingot instability on the bottom block during casting which is caused by the curved lower end of the ingot. Prior efforts to provide the ingot stability desired, particularly for EM casting, have not met with much success. For example, various shaped protuberances have been provided on the upper bottom block surface so that molten metal solidifies around them at the start of the cast and thereby stabilizing the ingot by the keying action. This method has been generally found to be successful in stabilizing the ingot, but the cavities in the ingot butt which result from the metal solidifying around the protuberances act as stress risers which frequently cause the ingot to crack. Sometimes the same protuberances also cause the bottom block to crack due to the high thermal stresses involved.

Similarly, various shaped recesses have also been utilized on the upper surface of the bottom block for essentially the same purpose, i.e., to key the butt end of the ingot and thereby prevent it from rocking or leaning during casting. This has not been very successful because water which becomes entrapped in the recess will flash when contacting molten metal causing metal explosions. It is to this problem that the present invention was developed.

DESCRIPTION OF THE INVENTION

This invention relates to an improved bottom block design suitable for use in the vertical DC casting and the vertical EM casting of large metal ingots or billets, particularly ingots having generally rectangular cross sections.

In accordance with this invention, the bottom block is provided with at least two holes, preferably four or more holes, for draining the coolant which collects between the top of the bottom block and the butt end of the ingot, and fan shaped recesses are provided in the upper surface of the bottom blocks around a major portion of each of the drainage holes. The fan shaped recesses radiate inwardly toward the central portion of the bottom block and the lower surfaces of the recesses are inclined upwardly and generally toward the central portion of the bottom block. At the bottom of the recess in each drainage hole, means are provided which allow the passage of coolant through the drainage hole but which prevent the passage of molten metal.

At the start of the cast, molten metal fills the recess and solidifies into a downwardly directed appendage to the butt of the ingot which is in essentially the same shape as the recess. Due to the ingot butt shrinking and curling from the solidification and cooling, these appendages to the ingot butt slide up and the inclined lower surfaces of the recesses in the bottom block and thereby stably support the ingot during the remainder of the cast. The recesses should not, however, be positioned around drain holes in areas of maximum ingot butt curl because the appendages that form will lift out of the recess completely when the butt curls, not slide up the inclined recess in accordance with the invention. Most of the ingot rocking is in the direction of the widest dimension or width of the ingot, so by having at least two appendages appropriately disposed toward the narrow faces of the ingot butt, the ingot can be effectively balances on the bottom block. Preferably, at least three recesses are provided in the bottom block when casting large round billet and at least four are preferably provided when casting large rectangularly shaped ingots.

One of the best means which allows for the passage of water but not molten metal at the bottom of the recess is a screen having a mesh size which is large enough to allow water to pass through the screen and thus away from the interface between the bottom block and the ingot but which is small enough to block any molten metal flow through the screen. Screen openings from about 0.01–0.1 inch have been found suitable. Other devices with the same sized apertures can also be used. Generally, the viscosity of the molten metal determines the screen opening desired. The temperature and the composition of the molten metal determine its viscosity.

The upper portion of the drainage hole adjacent the fan shaped inclined surface is chamfered outwardly toward the edge of the bottom block to prevent the appendage from sticking or hanging up in the recess when the ingot butt curls and the appendages lift and slide up the inclined surfaces of the recesses. The fan shaped planar areas of the recesses radiate inwardly toward the central part of the bottom block and preferably have an angle of at least 90°. In this manner, the appendages which form on the ingot butt easily slide along the inclined planar areas as the ingot butt curls and shrinks inwardly as it solidifies and cools. By forming at least two downwardly directed projections on the ingot butt in accordance with the invention, the ingot is effectively supported and balanced during the remainder of the casting process even though the butt may shrink and curl significantly during the initial casting stages. Preferably, three or more drainage holes are provided for large round billet casting and four or more are provided for large rectangular ingot casting so that the large ingot or billet can be well supported and balanced during the casting process.

Reference is made to the drawings which further illustrate a preferred embodiment of the invention.

Figure 1:
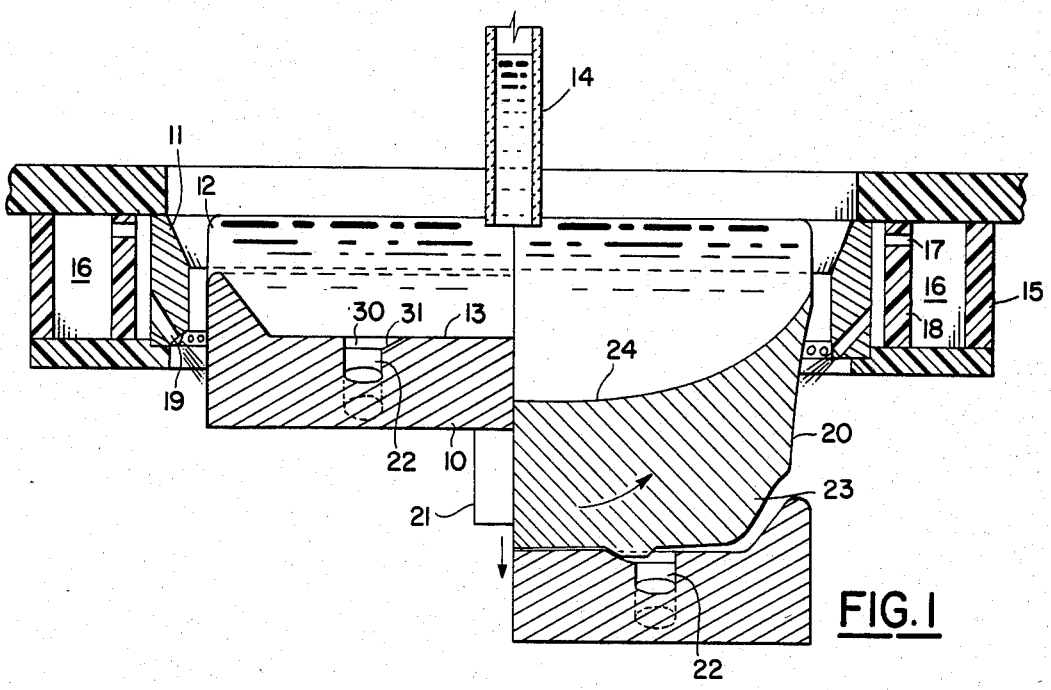
FIG. 1 is a cross sectional view of the bottom block in accordance with the invention. The left side of the drawing illustrates the start of the cast when the bottom block is positioned within the electromagnetic casting apparatus and the right side of the drawing illustrates the casting after start-up when the bottom block has been removed from the inductor.

The left side of FIG. 1 illustrates the start of the cast when the dish shaped bottom block 10 is positioned within the inductor 11 of an electromagnetic casting apparatus. The lateral shape of the column of molten metal 12 on the concave, dish shaped surface 13 of the bottom block 10 is controlled by the pressure developed by electromagnetic field induced by the inductor 11. Molten metal is fed to the bottom block 10 through downspout 14. The inductor 11 is provided with water jacket 15 for maintaining a body of coolant on the backside of the inductor 11 and coolant passes from chamber 16 of water jacket 15 through conduits 17 in baffle 18, down the backside of inductor 11 and out a plurality conduits 19 provided in the lower section of inductor 11 for discharging coolant onto the surface of ingot 20 which exits from the inductor 11. Bottom block 10 is supported by column 21 attached to a platen (not shown) which usually supports several bottom blocks in a multi-ingot casting station. Bottom block movement is shown by the arrow. Drainage holes 22 are provided in bottom block 10 to drain coolant which collects between the dish shaped bottom block surface 13 and the ingot butt 23 after the butt 23 curls at the start of the cast. Line 24 shows generally an idealized bell shaped solidification front. Although the line 24 shown in the drawing may indicate a sharp demarcation between solid and molten metal, in fact, there is a mushy zone of semi-solidified metal between the solid and liquid metal.

Figure 2:
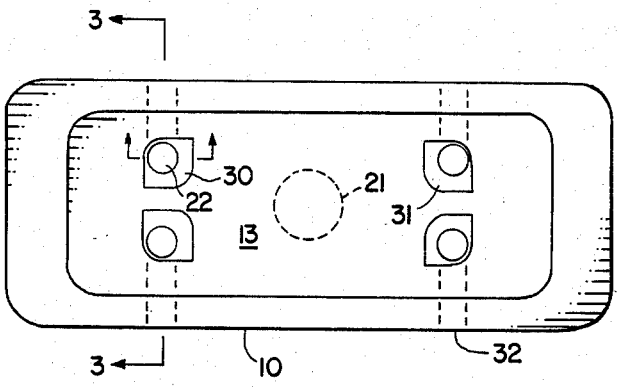
FIG. 2 is a plan view of the bottom block shown in FIG. 1.

FIG. 2 is a planar view of the bottom block 10 showing four drainage holes 22 and, as illustrated more clearly in FIGS. 3–6, each of the drainage holes 22 is provided with a fan shaped recess 30 at the upper portion thereof which has a lower surface 31 inclined upwardly toward surface 13 and inwardly toward the central portion thereof.

Figure 3:
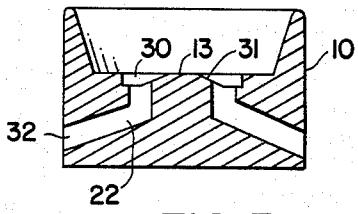
FIG. 3 is a cross sectional view of the bottom block taken along the lines III—III shown in FIG. 2.

FIG. 3 is a cross sectional view of the bottom block 10 showing the details of drainage hole 22 and the dished upper surface 13 of the bottom block 10 is drained through the holes 22 and out discharge openings 32 at the side of the bottom block 10.

Figure 4:
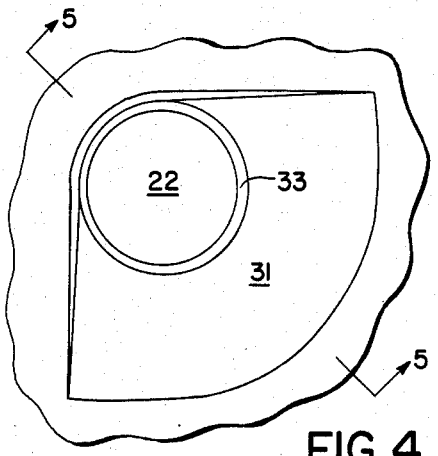
FIG. 4 is an enlarged planar view of one of the drainage holes shown in FIG. 2.
Figure 5:
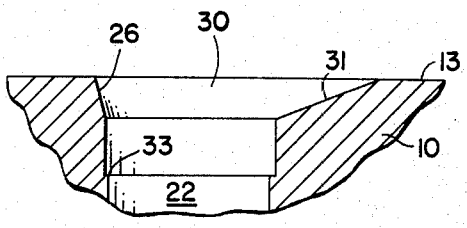
FIG. 5 is a cross sectional view taken along the lines V—V shown in FIG. 4.
Figure 7:
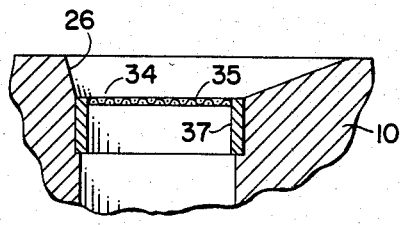
FIG. 7 illustrates the screen shown in FIG. 6 in position within the discharge hole 22.
Figure 6:
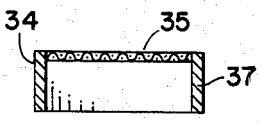
FIG. 6 is a cross sectional view of a screen which is adapted to be inserted into the drainage holes in the bottom block which allow the passage of water but prevent the flow of molten metal at the start of the cast.

FIGS. 4–6 illustrate that the discharge drainage holes 22 are provided with shoulders 33 onto which are seated screen elements 34 shown in more detail in FIGS. 6 and 7. The screen cloth 35 has mesh openings sufficiently small to prevent molten metal from flowing through the screen at the start of the cast yet sufficiently large enough to allow water to flow through and thereby drain water which collects on surface 13. A chamfered section 26 is provided in the upper portion of the drainage hole 11 away from the inclined surface 31 to prevent any hang up of the appendages 40 to ingot butt 23 at the start of the cast when the ingot butt shrinks and curls, thereby lifting the appendages 40 out of the recesses 30 and up the inclined surface 31. As shown in FIG. 7, the screen element 34 is provided with a short cylindrical collar 37 which rests on the shoulder 33 at the top of the drainage hole 22.

Figure 8:
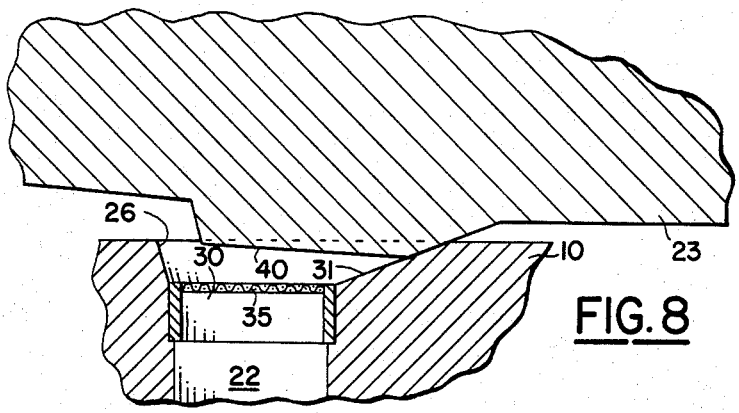
FIG. 8 illustrates the movement of the appendages formed on the bottom surface of the ingot butt up the inclined recess surface when the ingot butt shrinks and curls at the start of the cast.

At the start of the cast, molten metal is fed to bottom block 10 and the recesses 30 fill with molten metal which solidifies into appendages 40 on the ingot butt 23 which are essentially in the same shape as the recesses 30. The screen openings are sufficiently small to prevent the molten metal from flowing through the screen cloth 35 and down into the drain holes 22. The ingot butt 23 solidifies and begins to shrink and curl, causing the appendages formed in the recesses 30 to lift and then slide up onto the lower inclined surfaces 31 thereof as shown in FIG. 8. In this manner, the ingot 20 is supported by two or more appendages 40 which rest on the inclined surfaces 31 of the recesses 30. Any coolant which collects on the bottom block surface 13 will flow through the screen cloth 35 and out the drain holes 22 and then out the discharge openings 32.

Figure 9:
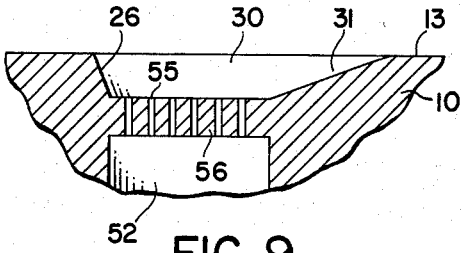
FIG. 9 illustrates an alternate means for draining water which collects on the bottom block.

FIG. 9 illustrates alternative to the use of screens in which drainage holes 52 are not completely machined through to the top surface 13. A plurality of smaller holes 55 are drilled in the remaining unmachined portion 56 with the aperture size ranging from 0.01 to 0.1 inch.

It is obvious that various modifications and changes can be made to the invention without departing from the spirit thereof and the scope of the appended claims.

I claim:

1. A bottom block for use in the vertical DC or EM continuous casting of large elongated ingots or billets, said block having a dish-shaped upper surface provided with a plurality of drain holes, said drain holes being adapted to remove coolant that collects on the said upper surface from said surface and recess means associated with at least certain of said drain holes for directing coolant to the drain holes and alleviating sticking of the butt portion of an ingot with said bottom block while at the same time maintaining sliding contact with said ingot butt portion as the butt portion of the ingot shrinks and curls due to cooling and solidification, said drain holes are located closer to one end of said recess means said recess means including inclined surfaces that project upwardly and inwardly from their associated drain holes as well as toward the central part of the bottom block, said recess means also being adapted to receive molten metal at the start of the casting operation and initial formation of the butt portion of the ingot, which molten metal upon solidification forms appendages that in part have configurations which match and mate with the inclined surfaces of the recess means whereby the appendages can maintain sliding contact with the recess means to thereby stably support the ingot on and minimize ingot movement relative to the bottom block during the casting operation.

2. The bottom block of claim 1 including means associated with the said recess means and drain holes for allowing the passage and drainage of coolant but not of molten metal from the bottom block.

3. The block of claim 2 wherein the coolant passage and drainage means include openings from about 0.01 to 0.1 inch in maximum dimension.

4. The bottom block of claim 2 wherein the coolant passage and drainage means comprise a removable screen element having mesh openings from about 0.01 to 0.1 inch in maximum dimension.

5. The bottom block of claim 1 having a substantially rectangular shape in plan.

6. The bottom block of claim 1 wherein the inclined surface of a recess means radiates inwardly toward the center of the bottom block and fans out through an angle of at least 90°.

7. The bottom block of claim 4 wherein the drain holes are provided with shoulders for removably supporting the screen element.

8. The bottom block of claim 2 including a screen element and wherein a drain hole has a shoulder for supporting the screen element.

9. The bottom block of claim 7 wherein the inclined surface of a recess means radiates inwardly toward the center of the bottom block and fans out through an angle of at least 90°.

10. The bottom block of claim 1 wherein said block is also provided with chamfered sections located adjacent said drain holes and recess means.

11. The bottom block of claim 7 wherein said block is also provided with chamfered sections located adjacent said drain holes and recess means.

* * * * *

UNITED STATES PATENT AND TRADEMARK OFFICE

CERTIFICATE OF CORRECTION

PATENT NO. : 4,509,580

DATED : April 9, 1985

INVENTOR(S) : David G. Goodrich

It is certified that error appears in the above-identified patent and that said Letters Patent are hereby corrected as shown below:

Column 2, Line 67, "slide up and the" should be --slide up the--

Column 3, Line 11, "balances" should be --balanced--

Column 4, Line 61, "hole 11" should be --hole 22--

Column 6, Line 14, "The block" should be --The bottom block--

Signed and Sealed this

*Third* Day of *September 1985*

[SEAL]

*Attest:*

DONALD J. QUIGG

*Attesting Officer* *Acting Commissioner of Patents and Trademarks - Designate*